US008537059B2

(12) United States Patent
Sauer et al.

(10) Patent No.: US 8,537,059 B2
(45) Date of Patent: Sep. 17, 2013

(54) COOLING SYSTEM FOR PANEL ARRAY ANTENNA

(75) Inventors: Rohn Sauer, Encino, CA (US); Clifton Quan, Arcadia, CA (US); David E. Roberts, San Pedro, CA (US); Scott Johnson, Torrance, CA (US)

(73) Assignee: Raytheon Company, Waltham, MA (US)

( * ) Notice: Subject to any disclaimer, the term of this patent is extended or adjusted under 35 U.S.C. 154(b) by 916 days.

(21) Appl. No.: 12/623,302

(22) Filed: Nov. 20, 2009

(65) Prior Publication Data

US 2011/0122033 A1 May 26, 2011

(51) Int. Cl.
*H01Q 1/28* (2006.01)
*H01Q 13/10* (2006.01)

(52) U.S. Cl.
USPC ..... 343/705; 343/708; 343/770; 343/771; 343/853; 343/909

(58) Field of Classification Search
None
See application file for complete search history.

(56) References Cited

U.S. PATENT DOCUMENTS 4,999,469 A * 3/1991 Dudley et al. ..... 219/693
5,099,254 A * 3/1992 Tsukii et al. ..... 343/853
5,276,455 A * 1/1994 Fitzsimmons et al. ..... 343/777
5,854,607 A * 12/1998 Kinghorn ..... 343/853
6,992,629 B2 1/2006 Kerner et al.
7,032,651 B2 4/2006 Winslow et al.
7,129,908 B2 * 10/2006 Edward et al. ..... 343/878
7,898,810 B2 * 3/2011 Mason et al. ..... 361/717
8,384,609 B2 * 2/2013 Scott ..... 343/771
2005/0253770 A1 * 11/2005 Edward et al. ..... 343/824
2005/0270250 A1 * 12/2005 Edward et al. ..... 343/878
2007/0035448 A1 * 2/2007 Navarro et al. ..... 343/700 MS
2007/0090997 A1 * 4/2007 Brown et al. ..... 343/700 MS
2010/0069700 A1 * 3/2010 Brunsell et al. ..... 588/255
2010/0245179 A1 * 9/2010 Puzella et al. ..... 343/702
2011/0036500 A1 * 2/2011 DiVergilio et al. ..... 156/345.48
2012/0218149 A1 * 8/2012 Edward et al. ..... 342/368

* cited by examiner

*Primary Examiner* — Trinh Dinh
(74) *Attorney, Agent, or Firm* — Christie, Parker & Hale, LLP

(57) ABSTRACT

The present invention relates to panel array antennas, and more particularly to a cooling system for an antenna such as a jet stream conformal panel array antenna. In one embodiment, a panel array antenna for an aircraft includes a closed-loop fluid flow path that passes through the panel array assembly and dissipates heat to the jet stream outside the aircraft. A fluid such as pressurized air passes through this closed-loop path, flowing through strategically-placed openings in the layers of the panel array assembly and flowing over and around the hot electrical components in the panel assembly. The air is heated by these electrical components, and the heated air then flows through the flow path under the top sheet, dissipating the heat to the jet stream outside. In one embodiment, a panel array antenna includes a panel assembly having a top layer through which the antenna radiates or receives a signal, and a fluid flow path through the panel assembly. A first portion of the fluid flow path is disposed below the top layer such that a fluid passing through the first portion of the fluid flow path is in heat transfer proximity to the top layer.

20 Claims, 10 Drawing Sheets

22a
60
60a
58
59
34a
68
72
74
76a
54
64
26c
70
58
72
24
26a
31
57
20
26b
60b
30
32
24
34
34b
36
72
26
26c
38
76b
40
26d
78
40b
42
80
44
26e
84
22b
22

COOLING SYSTEM FOR PANEL ARRAY ANTENNA

FIELD OF THE INVENTION

The present invention relates to panel array antennas, and more particularly to a cooling system for an antenna such as a jet stream conformal panel array antenna.

BACKGROUND

Many types of aircraft, including combat airplanes, surveillance aircraft, and unmanned aerial vehicles, utilize panel array antennas. These antennas can be mounted on the outer skin of the aircraft, to radiate and/or receive radio frequency signals. Panel array antennas have a panel architecture, meaning that they are made up of several stacked panels or layers. These antennas may have a top layer that is exposed to the air flowing around the aircraft (the "jet stream"), a radiating layer (including the antenna elements that radiate and/or receive the radio frequency signals), an electronic circuit board layer including the electronics that generate the signal, and a bottom layer for mounting the antenna to the aircraft and connecting the antenna to the power and cooling systems on the aircraft.

Conformal panel array antennas are designed to conform to the exterior shape of the aircraft, so that they do not extend out from the aircraft substantially into the jet stream. Some panel array antennas extend out from the aircraft and into the jet stream flowing around the aircraft, but this design alters the flow of air around the aircraft, increases drag, and requires additional structural modifications and support. A conformal panel array antenna is mounted on or in the aircraft's outer skin, such that the antenna does not extend out into the jet stream. The overall radiation pattern of a conformal array results from the spatial superposition of all of the radiation patterns from the individual antenna elements making up the array.

Many aircraft would benefit from locating these conformal panel array antennas in various places around the aircraft's exterior skin, including the fuselage and wings, and including curved and flat surfaces on the aircraft. However, typical conformal panel array antennas require a cooling system in order to prevent the electronics within the various panel layers from overheating. In the prior art, a cooling plate is mounted on the rear side of the antenna, on the bottom surface of the antenna, opposite the jet stream. This cooling plate includes fluid circulation, fans, and/or heat sinks to draw heat away from the antenna. The cooling plate is powered by the aircraft's on-board power system, and it dissipates heat to the aircraft, such as to the aircraft's environmental control system, or to the aircraft's fuel. Thus, the cooling plate relies on the aircraft for power and cooling.

The need for a cooling element such as the cooling plate on the back surface of the antenna limits the use of conformal array panel antennas, because the cooling plate is typically flat, not curved, and requires operable connections to the aircraft for both power and heat disposal. Accordingly, a conformal panel array antenna with this cooling plate can be mounted on the aircraft skin only at locations where the cooling plate can be both structurally mounted to the aircraft and operably connected to the aircraft's power and cooling systems. Additionally, in drawing power and cooling from the aircraft, the cooling plate reduces the aircraft's available power, resulting in shorter flight duration for the aircraft and/or reduced power for other aircraft systems. The cooling plate also has other disadvantages, such as effectiveness (as it provides cooling only at the back surface of the antenna), weight, space, and cost.

A significant difficulty in designing more effective cooling systems for panel array antennas is the need to prevent leakage of the radio frequency signal that the antenna transmits. In order to prevent the signal from leaking, the antenna typically includes plates or layers that close out the antenna and prevent passage of radio frequency signals, so that the signal can be emitted in the desired direction, rather than radiating out in all directions. However, this closed structure also traps heat inside the antenna and makes cooling difficult. Another problem is the constrained space within the antenna. The electronic devices within the antenna are often packed closely together, limiting the available space for a cooling system.

Accordingly, there is still a need for an improved cooling system for a panel array antenna.

SUMMARY OF THE INVENTION

The present invention relates to panel array antennas, and more particularly to a cooling system for an antenna such as a jet stream conformal panel array antenna. In one embodiment, a panel array antenna for an aircraft includes a closed-loop fluid flow path that passes through the panel array assembly and dissipates heat to the jet stream outside the aircraft. A fluid such as pressurized air passes through this closed-loop path, flowing through strategically-placed openings in the layers of the panel array assembly and flowing over and around the hot electrical components in the panel assembly. The air is heated by these electrical components, and the heated air then flows through the flow path under the top sheet, dissipating the heat to the jet stream outside. The top sheet is the sheet of material that separates the internal components of the antenna from the jet stream and environment outside of the aircraft. This system uses the jet stream as a heat sink and integrates cooling into the antenna structure itself. In embodiments of the invention, the cooling plate mounted on the rear side of panel antennas in many prior art designs is not necessary, and as a result the closed-loop cooling system described herein reduces costs and enables the panel array antenna to be more efficiently and easily mounted at various locations on the aircraft.

In one embodiment, a panel array antenna includes a panel assembly having a top layer through which the antenna radiates or receives a signal, and a fluid flow path through the panel assembly. A first portion of the fluid flow path is disposed below the top layer such that a fluid passing through the first portion of the fluid flow path is in heat transfer proximity to the top layer.

In another embodiment, a panel array antenna includes a top layer; a radiating layer comprising one or more channels below the top layer; an intermediate layer comprising one or more screens below the radiating layer; an electronics layer comprising one or more openings and one or more electronic devices below the intermediate layer; a fluid flow path passing through the channels, the screens, and the openings; and one or more fans that circulate a fluid through the fluid flow path.

DETAILED DESCRIPTION OF THE INVENTION

The present invention relates to panel array antennas, and more particularly to a cooling system for an antenna such as a jet stream conformal panel array antenna. In one embodiment, a panel array antenna for an aircraft includes a closed-loop fluid flow path that passes through the panel array assembly and dissipates heat to the jet stream outside the aircraft. A fluid such as pressurized air passes through this closed-loop path, flowing through strategically-placed openings in the layers of the panel array assembly and flowing over and around the hot electrical components in the panel assembly. The air is heated by these electrical components, and the heated air then flows through the flow path under the top sheet (which may be the skin of the aircraft), dissipating the heat to the jet stream outside. This system uses the jet stream as a heat sink and integrates cooling into the antenna structure itself. In embodiments of the invention, the cooling plate mounted on the rear side of panel antennas in many prior art designs is not necessary, and as a result the closed-loop cooling system described herein saves costs and enables the panel array antenna to be more efficiently and easily mounted at various locations on the aircraft.

Figure 1:
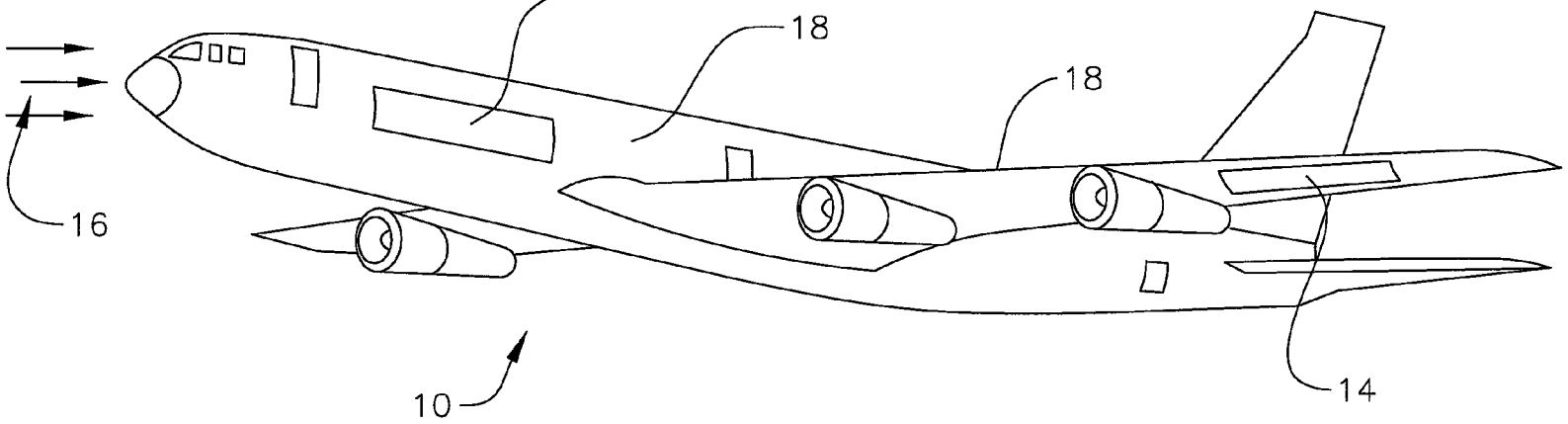
FIG. 1 is a perspective view of an aircraft with two conformal panel array antennas, according to an embodiment of the invention.

Referring to FIG. 1, in one embodiment of the invention, an aircraft 10 includes two panel array antennas 12, 14. The first panel array antenna 12 is mounted to the fuselage of the aircraft, and the second panel array antenna 14 is mounted to a wing. Both antennas 12, 14 conform to the exterior profile of the aircraft, so that in this embodiment they do not extend out into the jet stream 16 passing around the aircraft 10. The conformal antennas can be mounted to the aircraft in several ways. In one embodiment, they are mounted to the exterior surface of the aircraft skin 18, similar to a decal. In another embodiment, they are mounted into the aircraft's skin 18, similar to windows cut into the aircraft. In this latter case, the antennas can be made flush with the outer skin 18 of the aircraft, so that they do not affect the jet stream 16 and do not create any additional drag or change the aircraft's radar signature. However, the invention is not limited to conformal antennas, and antennas according to an embodiment of the invention may extend out from the aircraft or other platform, rather than being mounted flush with the platform's exterior surface.

Figure 2:
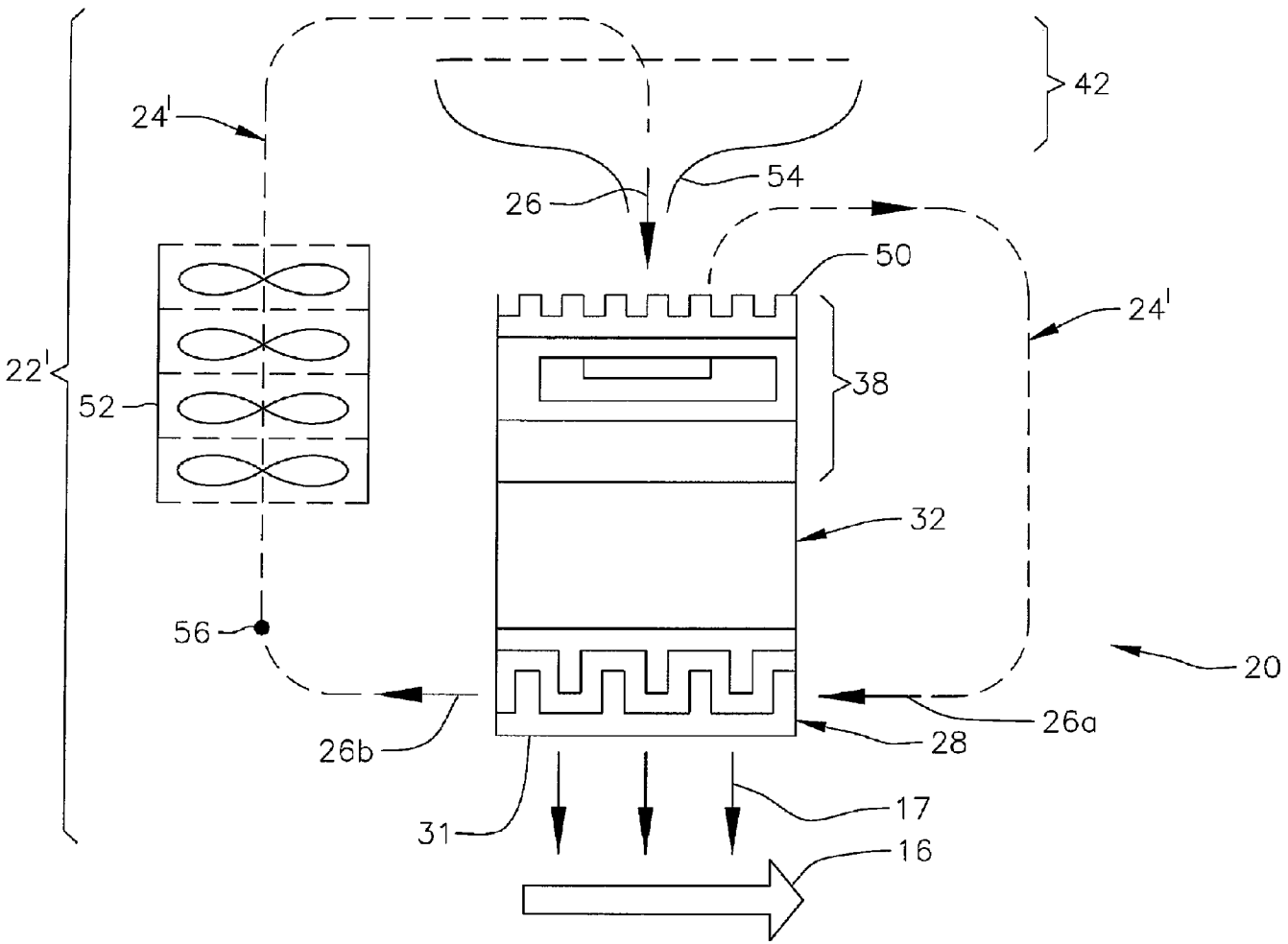
FIG. 2 is a schematic representation of a cooling system for a panel array antenna according to an embodiment of the invention.

In embodiments of the invention, a panel array antenna with an improved cooling system is provided. A schematic view of such a cooling system is shown in FIG. 2. In the embodiment of FIG. 2, a panel array antenna 20 includes a panel assembly 22', which includes various layers of the antenna, and a fluid flow path 24' that passes around and through the various layers of the panel assembly 22'. Any suitable fluid may be circulated through the flow path 24'. In one embodiment, the fluid is air.

In the embodiment shown in FIG. 2, a panel assembly 22' is made up of several layers, including a radome layer 28, a radiating layer 32, and an electronics layer 38. When the term "radiating layer" or "radiating element" is used herein, it refers to the layer or element of the panel assembly that receives and/or transmits the radio frequency signal. This layer could receive only, transmit only, or both receive and transmit the signals. The radiating layer 32 includes the individual antenna elements that transmit radio frequency signals through the radome layer 28. The outer surface 31 of the radome layer 28 is exposed to the jet stream 16.

The electronics layer 38 is on the opposite side of the radiating layer 32 from the radome layer 28. The electronics layer 38 includes electronic devices such as microchips, microprocessors, and/or memory devices that generate the radio frequency signals to be radiated out by the radiating layer 32. These electronic devices generate heat during operation. The electronics layer 38 may generate the most heat of all of the various layers in the panel assembly 22'. Absent any cooling system, the electronics in this layer are at risk of overheating. Overheating of the panel assembly 22' can lead to malfunction of the electronic devices, and/or delamination of the assembly 22' from the aircraft or other structural failure of the assembly.

In one embodiment, the electronics layer 38 includes one or more fins 50 that are attached to the electronic devices. The fins extend out from the electronic devices and increase the surface area that is exposed for cooling purposes. Cool air is blown at these fins 50 to draw heat away from the electronic devices in the layer 38.

The fluid flow path 24' is shown in dotted lines in FIG. 2, in schematic form. The fluid in the flow path, such as air, flows through the radome layer 28 where it is cooled by the jet stream 16. Heat 17 that the fluid has obtained from the panel assembly 22' is dissipated to the jet stream 16 via conduction through the outer surface of the radome layer 28, which is exposed to the jet stream 16 and therefore transfers heat to the jet stream by convection. This cools the air in the flow path 24'. The cooled air then flows through a set of fans or blowers 52 that circulate the fluid through the flow path 24'. The fluid passes from the fans 52 through a jet impingement layer 42, which includes strategically placed openings such as nozzles 54 that direct the fluid toward the electronic devices in the electronics layer 38. As indicated in FIG. 2, the fluid passes through the nozzle 54 and toward the fins 50 extending out from the electronics layer 38. This fluid flows around the fins 50, absorbing heat from the fins and cooling the electronics layer 38. The fluid then flows back to the radome layer 28, where the fluid dissipates the absorbed heat 17 to the jet stream 16.

The radome layer 28 is provided above the radiating layer 32 to protect the radiating elements and other sensitive electronics in the assembly 22' from the environmental elements such as rain, sunlight, dirt, etc. The radome layer 28 conceals the antenna below it, so that the existence and location of the antenna is not readily visible. The radome 28 also provides a smooth outer surface 31 over which the jet stream 16 flows. The radome layer 28 includes hollow space through which the radio frequency signals received or transmitted by the antenna can pass. In embodiments of the invention, this hollow space is also used as part of the flow path 24'. Fluid is circulated through this path 24' to dissipate heat through the outer surface 31 to the jet stream 16.

The flow path 24' shown schematically in FIG. 2 passes through the radome layer 28 itself. As the fluid flows from the radome layer 28 to the electronics layer 38, and then from the electronics layer 38 back to the radome layer 28, the flow path 24' can take several alternative paths. In one embodiment, the flow path passes through passages such as ducting around the panel 22', which transports the cool fluid 26*b* to the electronics layer 38, and then through additional passages or ducting that transports the heated fluid 26*a* back to the radome layer 28. In another embodiment, the flow path passes directly through the various layers of the panel assembly 22', rather than through separate ducting. In such an embodiment, the flow path is integrated within the various layers of the panel assembly itself. The cool fluid 26*b* is diverted through the radiating layer 32 and through the electronics layer 38 to the jet impingement layer 42, where it is sent through the nozzle 54 to circulate around the fins 50. The heated air 26*a* then passes back through the electronics layer 38 and the radiating layer 32 to the radome layer 28, where it dissipates the heat 17 to the jet stream 16.

In one embodiment, the cooling system includes a pump 56 that is in communication with the flow path 24', in order to maintain the fluid in the flow path at a sufficient pressure so that the fluid will circulate through the path 24'. In one embodiment the flow path 24' is maintained at a pressure that is equal to atmospheric pressure at about 10,000 feet elevation. The pump 56 can also replenish the fluid in the flow path 24' in the case of a leak. The pump 56 may be a local pump that draws air from the atmosphere, or it may draw from pressurized air inside the aircraft, using the aircraft's on-board pressurization system that keeps the aircraft cabin pressurized.

In one embodiment, the fluid flow path is a closed-loop path. That is, the fluid in the path is recycled and re-used. After the fluid passes through the panel assembly 22', accumulates heat from the various layers and electronics in the assembly 22', and dissipates this heat to the jet stream 16, the fluid repeats this cycle. Of course, the fluid may be replenished periodically by a pump such as pump 56, in the case of a leak, or for repairs or maintenance. However, in operation, the fluid in the flow path 24' is recycled rather than replaced with each cycle through the flow path. This closed-loop design is efficient and compact.

Figure 3:
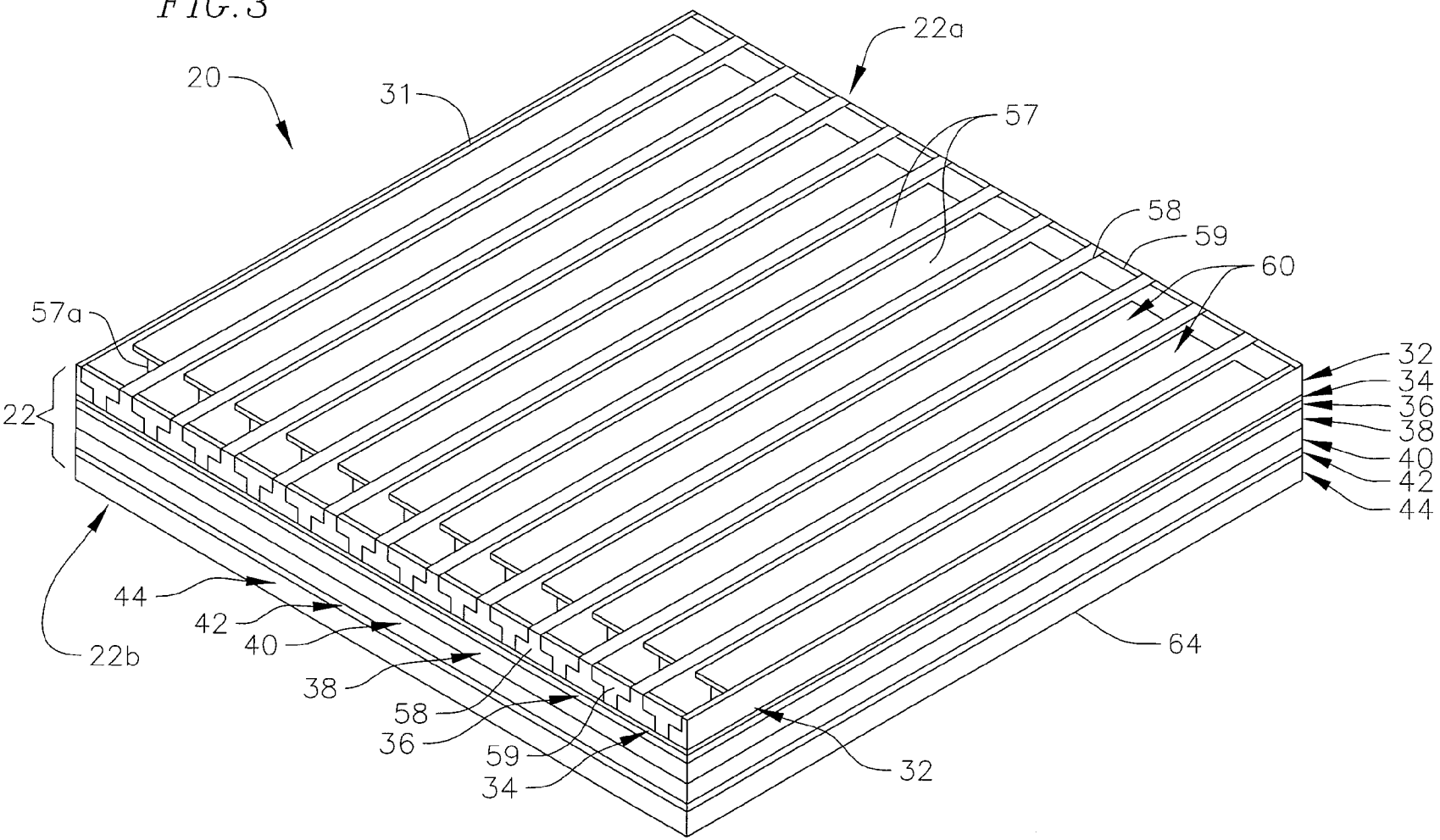
FIG. 3 is a perspective view of a panel array antenna according to an embodiment of the invention.
Figure 4:
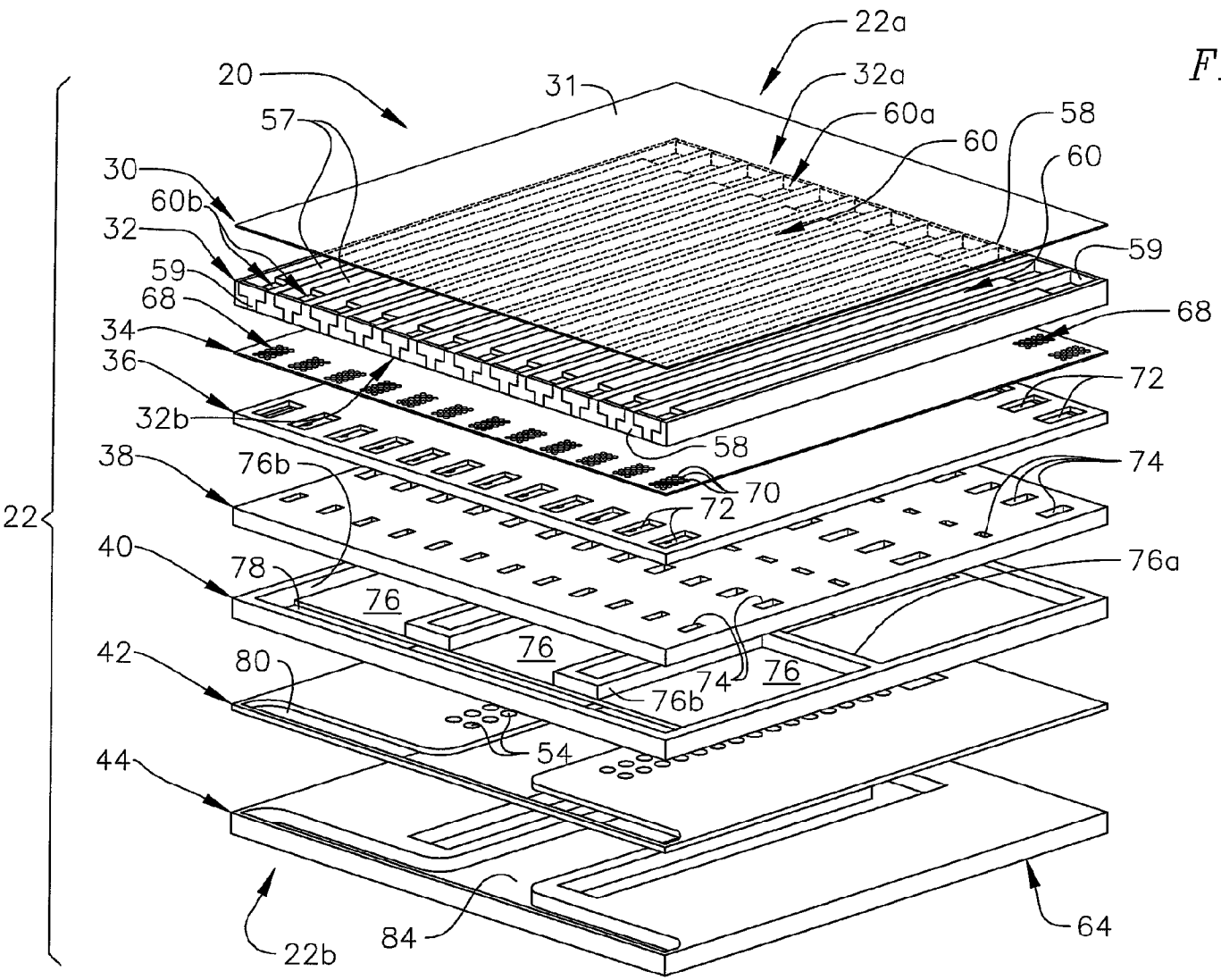
FIG. 4 is an exploded view of a panel array antenna according to the embodiment of FIG. 3.
Figure 5:
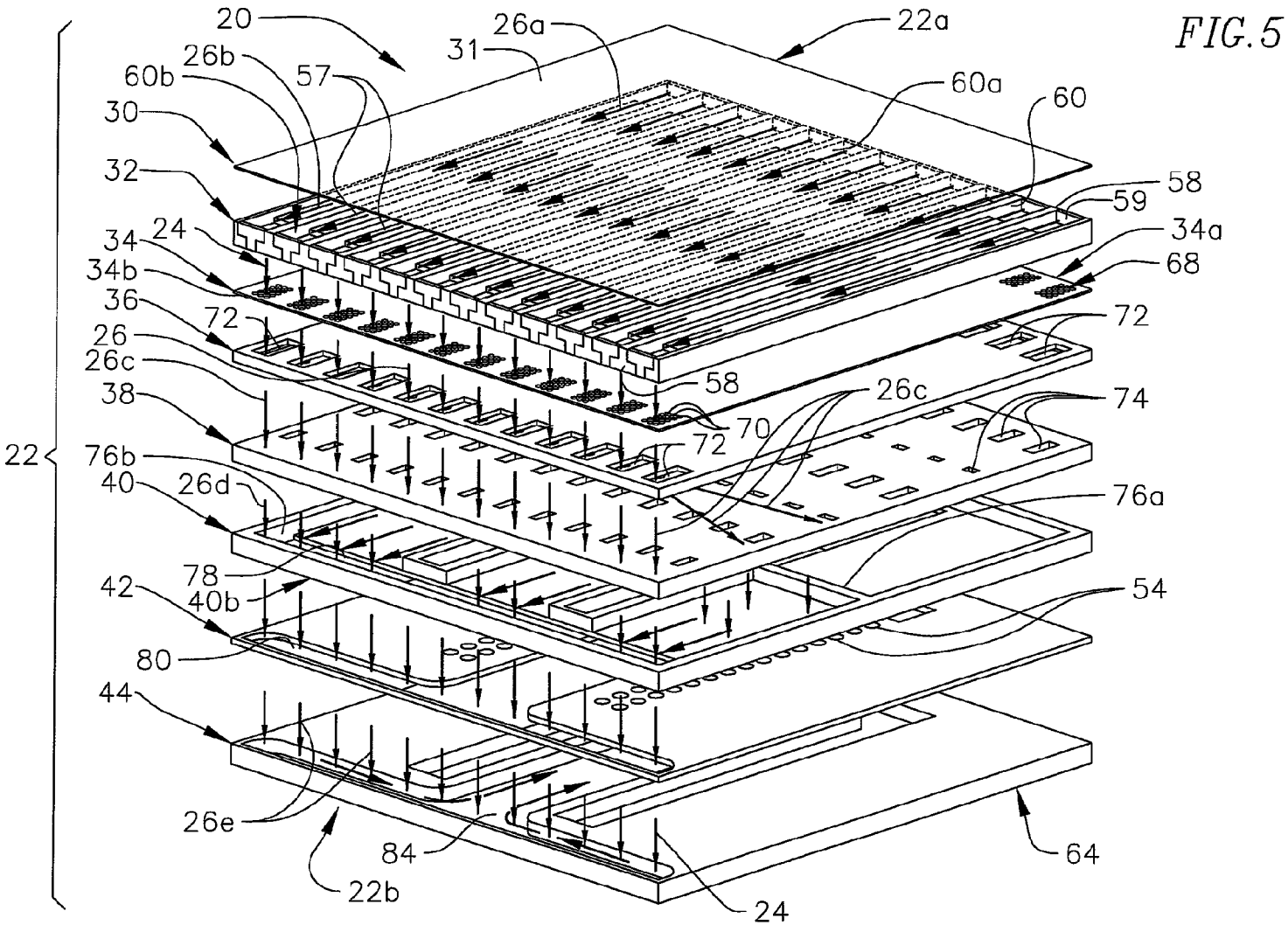
FIG. 5 is an exploded view of a panel array antenna according to the embodiment of FIG. 3, showing a portion of a fluid flow path.

Another embodiment of a panel array assembly 22 with a fluid flow path 24 is shown in FIGS. 3, 4, and 5. The antenna 20 includes the panel assembly 22 made up of various layers. The outer-most layer is the top sheet 30, which includes an outer surface 31 exposed to the jet stream. The area of the top sheet 30, covering the radiating layer 32, may also be referred to as the antenna aperture (the area through which the radio frequency signal is transmitted or received). The top sheet 30 may be made from a fiber reinforced resin, which allows both transfer of heat to the jet stream and passage of radio signals. In this embodiment, the fluid flow path 24 passes directly through the panel assembly 22, rather than simply around it or along an end surface of it. The various layers of the panel assembly 22 include strategically-positioned holes, openings, and passages that allow the fluid to move through the panel assembly 22, as described in more detail below.

Moving in order through the panel assembly 22, the next layer is the radiating layer 32. The radiating layer 32 includes the individual antenna elements or "stubs" 58 that transmit the radio frequency signal out from the antenna. The stubs 58 extend along the length of the radiating layer 32, between opposite ends 32*a*, 32*b* (see FIG. 4). The antenna elements 58 can be any radiating element such as continuous transverse stub (CTS) strips, cavity-back long slots, flared notches, flared dipole, or strips of conventional dipoles. These various options will be known to those skilled in the art. In one embodiment, the radiating layer 32 is adjacent the top sheet 30, so that the radiating elements 58 are positioned to transmit signals directly through the top sheet 30 and away from the antenna 20.

Between these stubs 58 are channels 60 that set the stubs 58 apart from each other. These channels 60 provide space around each stub within which the radio frequency signal from the stub travels. The particular sizing of the channels 60 and stubs 58 depends in part on the particular antenna, its desired performance, and the radiating frequency. The channels are closed at opposite ends by caps or seals 59. The fluid in the flow path 24 passes through these channels 60 as described more fully below. In one embodiment, a filler piece such as a nonconductive strip 57 occupies a portion of the channel 60. The fluid moving through the channel 60 passes over this strip 57, so that the fluid passes close to the top sheet 30 to dissipate heat to the outside environment. In one embodiment, the strip 57 rests on caps 57*a* at opposite ends of the strip 57. The caps 57*a* elevate the strip 57 to the desired location to move the fluid path 24 close to the top sheet 30, and also prevent the fluid from passing under the strip 57. Thus, the space below the strip 57 is occupied by static air that does not flow through the flow path 24, while the space above the strip 57 forms part of the flow path 24. Alternatively, instead of using the thin strips 57, caps 57*a*, and static air below the strips 57, this space can all be occupied by one larger, thicker filler piece. However, this larger filler piece may increase the weight and cost of the panel array, in which case the thinner strip 57 with elevating caps 57*a* and static air below the strip 57 may be used to reduce weight.

The next layer is an intermediate layer 34. This layer contains microwave circuitry and interconnects between layers 32 and 36. At the same time, this layer closes out the radiating layer 32, preventing leakage of the radio frequency signals from the stubs 58 back through the antenna in the wrong direction. That is, without capping or closing the radiating layer 32, the signal transmitted by the stubs 58 could travel in all directions, including back through the antenna rather than out in the direction of the aperture, away from the antenna, as desired. The intermediate layer 34 may simply be a bottom layer of the radiating layer 32, closing out the channels 60.

In one embodiment, the intermediate layer 34 provides beam-steering functionality for the antenna. The layer 34 includes one or more varactor diodes, which are used in a phase shifter circuits to change the radiation profile of the antenna, to steer the radiated signal. The varactor diode changes the profile of the radio signal that passes through the stubs 58, to steer the beam in a particular direction, as is well known to those skilled in the art.

The next layer is a fluid collection layer 36, which diverts the fluid in the flow path 24 in a desired direction, as described in more detail below. The collection layer 36 may contain a series of protrusions such as pegs or discs 66 that extend out toward the electronics layer 38 (described next, with reference to FIG. 7). These protrusions 66 can transmit radio frequency signals toward and/or away from the radiating layer 32, and also carry structural load between the layers in the panel assembly 22, to prevent the assembly from becoming bowed or sagging in the center, between opposite ends 22*a*, 22*b*.

Figure 7:
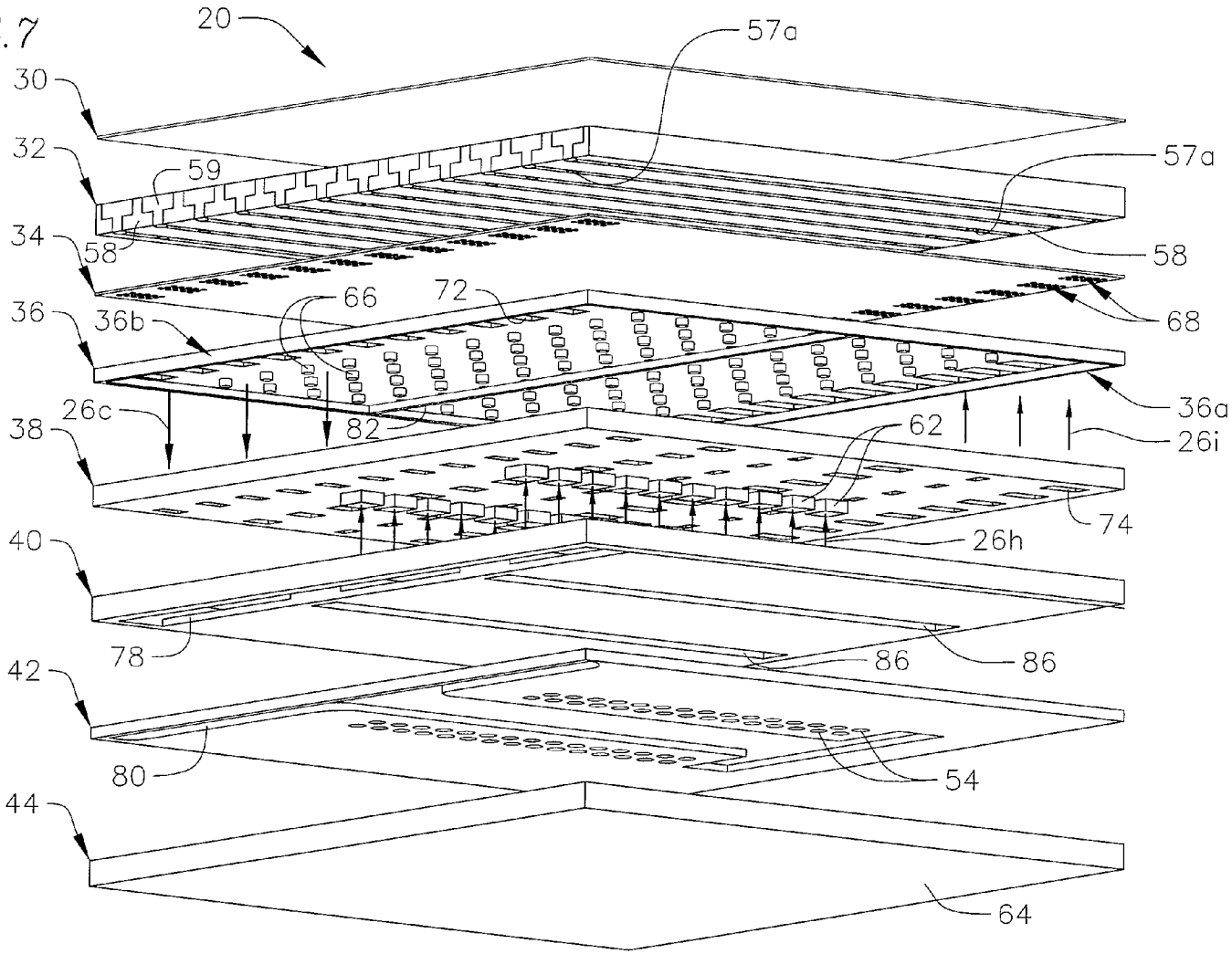
FIG. 7 is an exploded view of the panel array antenna of FIG. 5, showing yet another portion of the fluid flow path.

The next layer is the electronics layer 38, which is a multilayer mixed signal printed wiring board for distributing DC power, RF signals, and digital control signals to individual electronic devices 62 (see FIG. 7). As mentioned before, the electronic devices in this layer generate the radio frequency signals that the antenna transmits. Below the electronics layer 38 is a fluid distribution layer 40, a jet impingement layer 42, and a fluid circulation layer 44, all of which form part of the flow path 24 as described in further detail below. The surface of the fluid circulation layer 44 facing away from the top sheet 30 forms the bottom surface 64 of the panel assembly.

The fluid flow path 24 through these various layers will now be described. The movement of a fluid 26 is shown in arrows in FIGS. 5-8. Referring first to FIG. 5, the fluid 26 moves through the channels 60 along the radiating layer 32, below the top sheet 30. The fluid 26*a* at a first end 60*a* of the channels 60 carries heat from the panel assembly 22. As mentioned above, the channels 60 provide space around each stub within which the radio frequency signal from the stub travels. In the present embodiment, that space is also used as a flow path for a moving fluid, rather than a static space. That is, the wave guide path is also used as a cooling path. As the fluid passes through these channels 60, heat from the fluid radiates out into the jet stream through the top sheet 30. The strips 57 position the fluid 26*a* close to the top sheet 30 as the fluid travels along the channels 60. The portion of the fluid flow path passing through the channels 60 is disposed below the top layer 30 such that the fluid 26*a* passing through the fluid flow path is in heat transfer proximity to the top layer 30. Thus, the fluid 26*b* at the opposite end 60*b* of the channels is cooler than the fluid 26*a*.

The channels 60 are closed by the intermediate layer 34. At each end 34*a*, 34*b* of the intermediate layer, one or more screens 68 are formed in the intermediate layer 34. The screens 68 at the end 34*b* of the intermediate layer 34 allow the fluid 26 to flow out of the channels 60 and through the other layers in the panel assembly 22. Thus, when the fluid 26*b* reaches the end 60*b* of the channels 60, it is diverted downward through the screens 68 into the antenna structure. Each individual screen 68 is made up of several spaced-apart small holes 70 (see FIG. 9). As shown in FIG. 5, the screens 68 allow the fluid 26 to flow through the small holes 70, but do not allow radio signals to pass through the holes. The screens 68 are designed with these small holes 70 rather than one large opening, so that the screens can block the radio frequency signals emitted by the radiating layer 32. Much like the screen provided on the door of a microwave oven, the screens 68 block the radio waves from the radiating layer 32 and prevent them from passing through the antenna toward the bottom surface 64. Due to the wavelength of the radio signals, the waves cannot pass through these small holes 70. As a result, the panel assembly 22 does not suffer from radio frequency leakage, despite the presence of the holes 70 in the intermediate layer 34. The size of the holes 70 can be determined from the wavelength of the radio frequency signals transmitted and received by the antenna, as well as the acceptable level of radio frequency leakage. The wavelength and acceptable leakage depend on the desired performance of the antenna.

The fluid 26 passes from the screens 68 through openings 72 in the fluid collection layer 36. These openings 72 are strategically placed to divert the fluid 26 toward the electronics layer 38. In one embodiment, as shown in FIG. 5, the fluid 26*c* passes through the openings 72 and fans out to flow over the electronics layer 38. The particular arrangement shown in FIG. 5 is not the only option, and the openings 72 can be located and shaped to create any desired distribution of fluid toward the electronics layer 38. In one embodiment, the fluid is diverted to flow toward the center of the electronics layer 38. As mentioned above, the electronics layer 38 may the highest temperature layer in the panel assembly 22, so the flow path 24 circulates over and around this electronics layer 38 in order to allow the fluid in the flow path to absorb heat from the electronics layer.

In one embodiment, the openings 72 in the collection layer 36 are not constrained by the radio frequency wavelength, as the screens 68 are. Thus, the openings 72 in the collection layer 36 can be sized as spaced to divert the fluid and spread it out in any desired direction to circulate over the electronics layer 38. In other embodiments, the fluid can be fanned out in a different layer, such as below the electronics layer 38, to circulate the fluid along a bottom surface of the electronics layer (see, for example, FIG. 9, where the fluid fans out over the bottom surface of the electronics layer on its way back up toward the top sheet). Thus, the particular arrangement shown in FIG. 5, and the way the fluid 26*c* spreads out from the collection layer 36, is not the only way the layers and flow path can be arranged. In general, the flow path 24 can be modified based on the specific layers used in the panel assembly, and it is not limited to the particular arrangement shown in FIGS. 5-8.

As shown in FIG. 5, the electronics layer 38 includes small holes or openings 74 through which the fluid can pass. These openings 74 are strategically placed between the various electronic components on this layer 38. As shown in FIG. 7, the electronics layer 38 includes various spaced-apart electronic devices 62 such as microchips. Thus, some portions of the layer 38 cannot accommodate a hole or opening without disturbing or displacing an electronic device 62. The holes 74 are positioned away from the electronic devices 62 in areas where the electronics layer 38 can accommodate an opening. In one embodiment, these holes 74 are smaller than the openings 72 in the fluid collection layer 36, as the holes 74 are constrained by the placement and spacing of various electronic components. The electronics layer 38 includes a sufficient number of openings 74 to allow the fluid to continue along the flow path 24 through the panel assembly 22.

As shown in FIG. 5, the fluid 26*d* passes from the electronics layer 38 into the fluid distribution layer 40. The distribution layer 40 includes one or more fluid flow channels 76 that divert the fluid 26*d* toward an opening such as slot 78 near the second end 40*b* of the layer 40. The channels 76 are defined by rear and side walls 76*a*, 76*b*, respectively, that contain the fluid 26 and direct it toward the slot 78. In the embodiment shown, the channels 76 are formed in the distribution layer 40, rather than on the electronics layer 38, as the electronic devices on the electronics layer 38 constrain the space on that layer and reduce the space available for fluid channels to collect and redirect the fluid. However, in another embodiment, channels could be formed on the electronics layer, with the electronic devices rearranged to provide available space.

The fluid 26*d* passes through the slot 78 toward the jet impingement layer 42. The flow path 24 then passes through the jet impingement layer 42, through an opening such as slot 80. In one embodiment, the fluid distribution layer 40 and the jet impingement layer 42 are made together as one piece, such as one machined piece of aluminum. This is true for other layers in the panel assembly 22 as well, which may also be combined together and made as one integral piece, or provided as separate layers. In general, the various layers in the panel 22 may be made from any suitable materials, including composites, plastic, metal-coated plastic, aluminum, magnesium, steel, and other materials. The choice of material depends on the particular design and application as is known to those skilled in the art.

The fluid 26*e* then reaches the fluid circulation layer 44. In the embodiment shown in FIG. 5, this circulation layer 44 forms the bottom layer of the panel assembly, with the bottom surface 64 of the circulation layer 44 forming the bottom surface of the panel assembly 22, facing away from the top sheet 30. This layer 44 collects and re-circulates the fluid 26*e*, sending it back up through the panel assembly 22, back toward the radiating layer 32 to close the fluid path 24. In an embodiment of the invention, the fluid circulation layer 44 includes fans, blowers, air movers, micro air movers, or other devices that give velocity to the fluid 26, to keep it moving through the flow path 24. The fans are shown schematically in FIG. 2. In FIG. 5, the fans may be contained within the circulation layer 44, communicating with the flow path 24 to keep the fluid moving. In another embodiment, the fans may be contained elsewhere, and they may be designed to communicate with the flow path 24 to move the fluid through the flow path.

Figure 6:
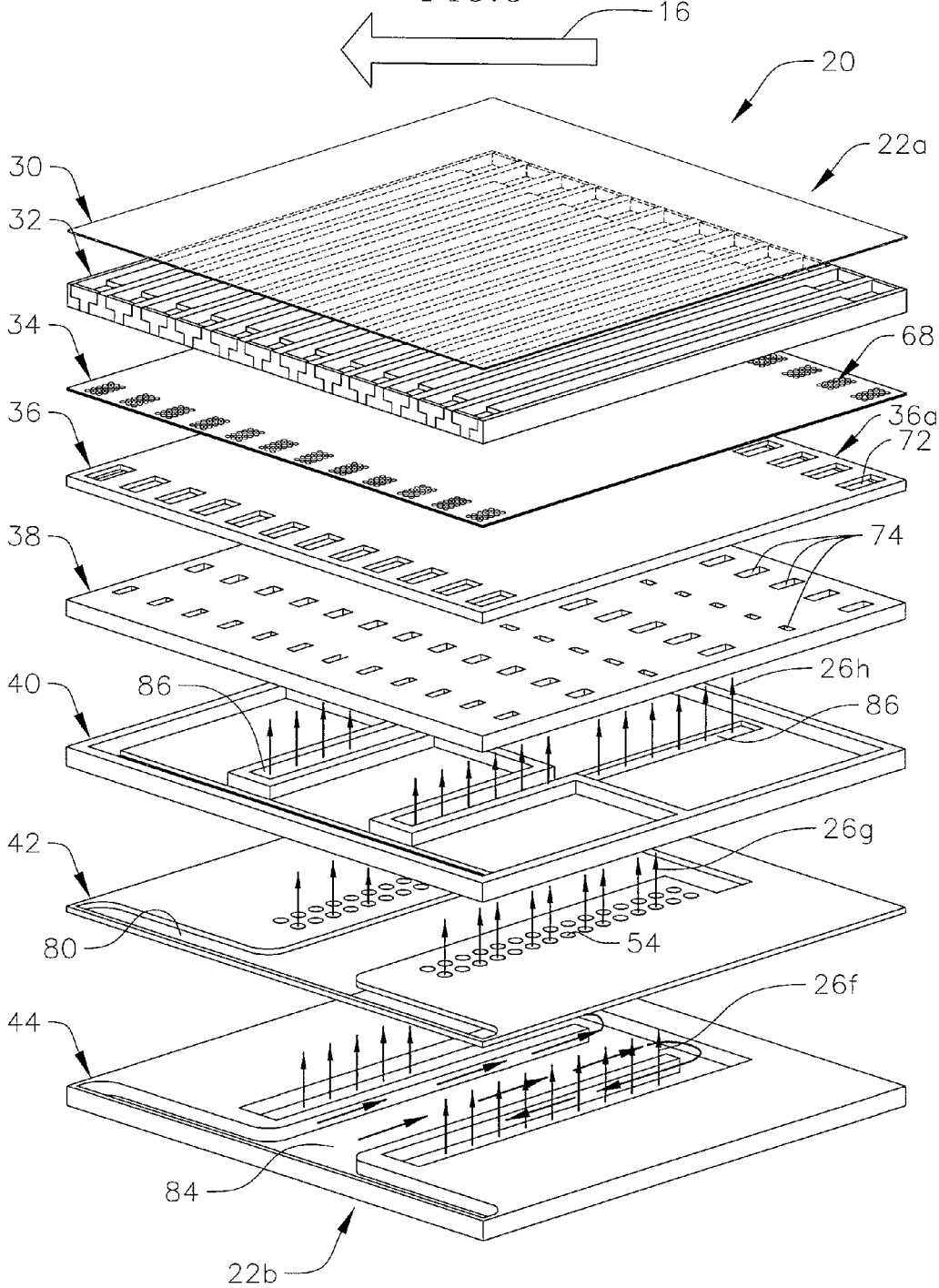
FIG. 6 is an exploded view of the panel array antenna of FIG. 5, showing another portion of the fluid flow path.

The circulation layer 44 includes a plenum 84 that receives the fluid 26*e* from the jet impingement layer 42. In one embodiment, the fluid flows through the plenum 84 and through the fans or blowers in the circulation layer 44. Referring now to FIG. 6, after the fluid 26*f* has passed through the fans, it flows back toward the jet impingement layer 42. The plenum 84 and the fans in the circulation layer 44 are arranged to collect the fluid 26*e* from the jet impingement layer 42 and redirect that fluid 26*f* back toward the jet impingement layer 42, effectively routing the fluid by about 180 degrees to send it back toward the top sheet 30.

The first time the fluid passed through the jet impingement layer, as it was moving away from the top sheet 30, it passed through the slot 80 at one end of the jet impingement layer 42. After passing through the circulation layer 44, the fluid 26*f* now passes through the nozzles 54 in the jet impingement layer 42. These nozzles accelerate the fluid 26*f* toward the fluid distribution layer 40. The accelerated air 26*g* exiting the nozzles flows through passages 86 in the distribution layer 40. The nozzles 54 and passages 86 are strategically located to direct the fluid 26*g* toward the electronic devices 62 on the electronics layer 38 (shown in FIG. 7). Depending on how the assembly 22 is stacked and how the devices 62 are distributed on the electronics layer, the plenum 84, nozzles 54, and passages 86 may be re-arranged or located as necessary to direct the fluid toward the devices 62.

As shown in FIG. 7, the fluid 26*h* that flows through the passages 86 is directed toward the electronic devices 62. The fluid 26*h* flows directly into and around these devices 62. In one embodiment, the devices 62 include fins 50 (see FIG. 2) that increase the surface area that contacts the fluid 26*h*. The accelerated fluid 26*h* flows through and around these fins, absorbing heat from the electronic devices 62. The fluid 26*h* passing through this portion of the fluid flow path is in heat transfer proximity to the electronics layer, so that it can absorb heat from the electronics layer.

Figure 8:
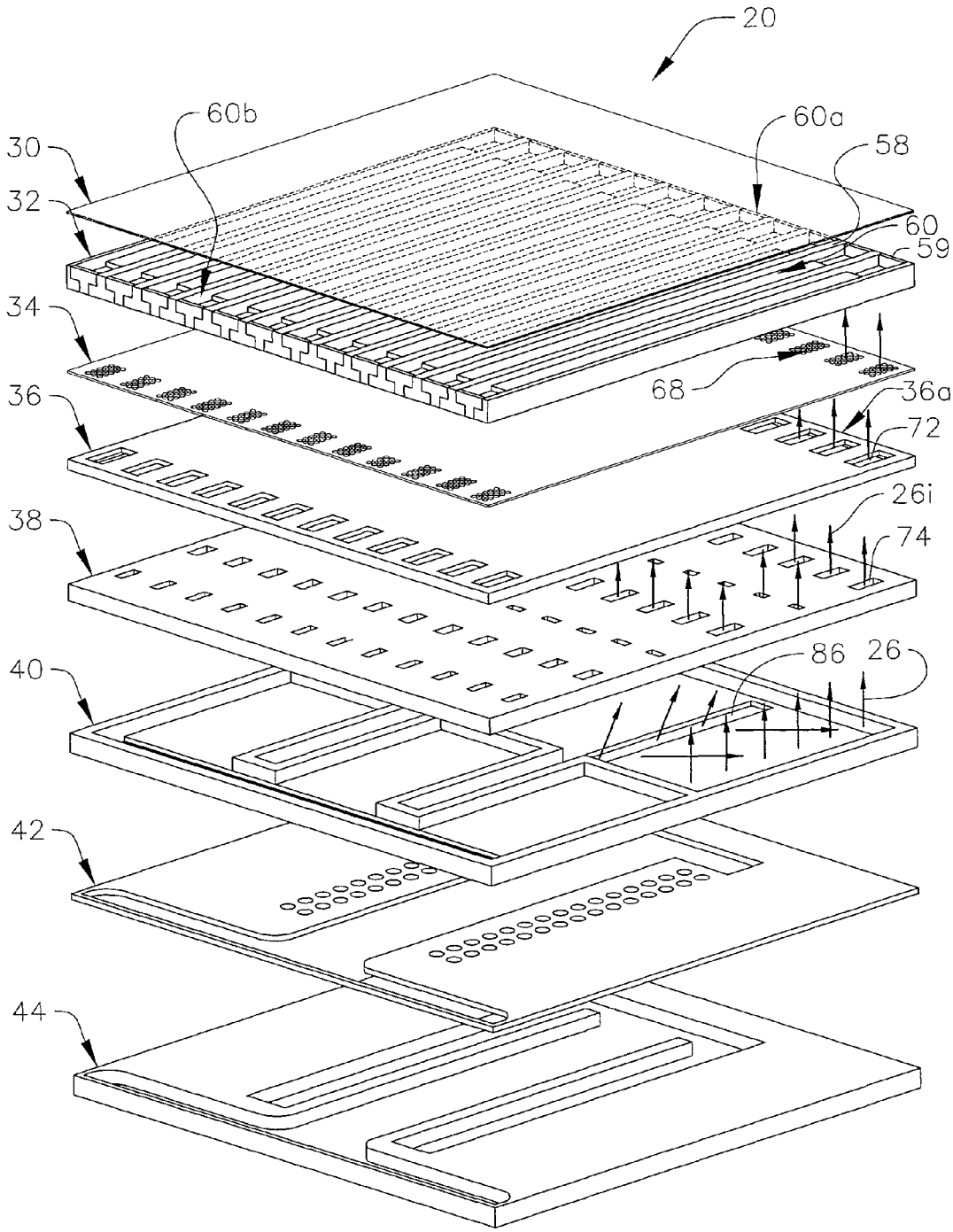
FIG. 8 is an exploded view of the panel array antenna of FIG. 5, showing still another portion of the fluid flow path.

After absorbing heat from the electronics layer 38, the heated fluid 26*i* flows through the openings 74 in the electronics layer, as shown in FIG. 8. The collection layer 36 collects the heated fluid 26*i* and diverts it toward the first end 36*a* of the layer 36, where the fluid can pass through the openings 72. The collection layer 36 may include a separating structure such as a dividing wall 82 (see FIG. 7) that separates the heated fluid 26*i* from the cool fluid 26*c*. This wall 82 prevents the cooler fluid 26*c* from flowing back to the channels 60, bypassing the rest of the flow path through the electronics layer 38 and circulation layer 44.

From the collection layer 36, the fluid passes through the screens 68 in the intermediate layer 34, and back into the channels 60 in the radiating layer 32 (see FIG. 8). The heated fluid 26*a* flows along the channels 60 and dissipates its absorbed heat through the top sheet 30 to the jet stream passing around the aircraft, as described above (see FIG. 5). The cooled fluid 26*b* at the opposite end of the channels is diverted back through the panel assembly 22 to repeat the cycle.

Notably, in one embodiment, the collection layer 36 acts to fan out the fluid 26*c* in the flow path 24 as it flows away from the top sheet 30, in order to circulate the fluid 26*c* over the hot electronics layer 38 (see FIG. 5). The collection layer 36 also collects the heated fluid 26*i* (see FIG. 8) and converges it back into a path through the screens 68 toward the top sheet 30. As a result, the fluid passes all the way through the channels 60, from one end 60*a* of the channels to the opposite end 60*b*, to maximize the transfer of heat from the fluid through the top sheet 30 to the jet stream. Additionally, the channels 60 are closed out except for at the screens 68, in order to prevent radio frequency leakage. Then, when the cooled fluid heads back through the panel assembly 22 away from the top sheet 30, it is spread out to circulate fully through the various layers, to provide sufficient cooling. Thus, the fluid flow path 24 is not confined to the outer edges of the various layers in the panel assembly 22.

Figure 9:
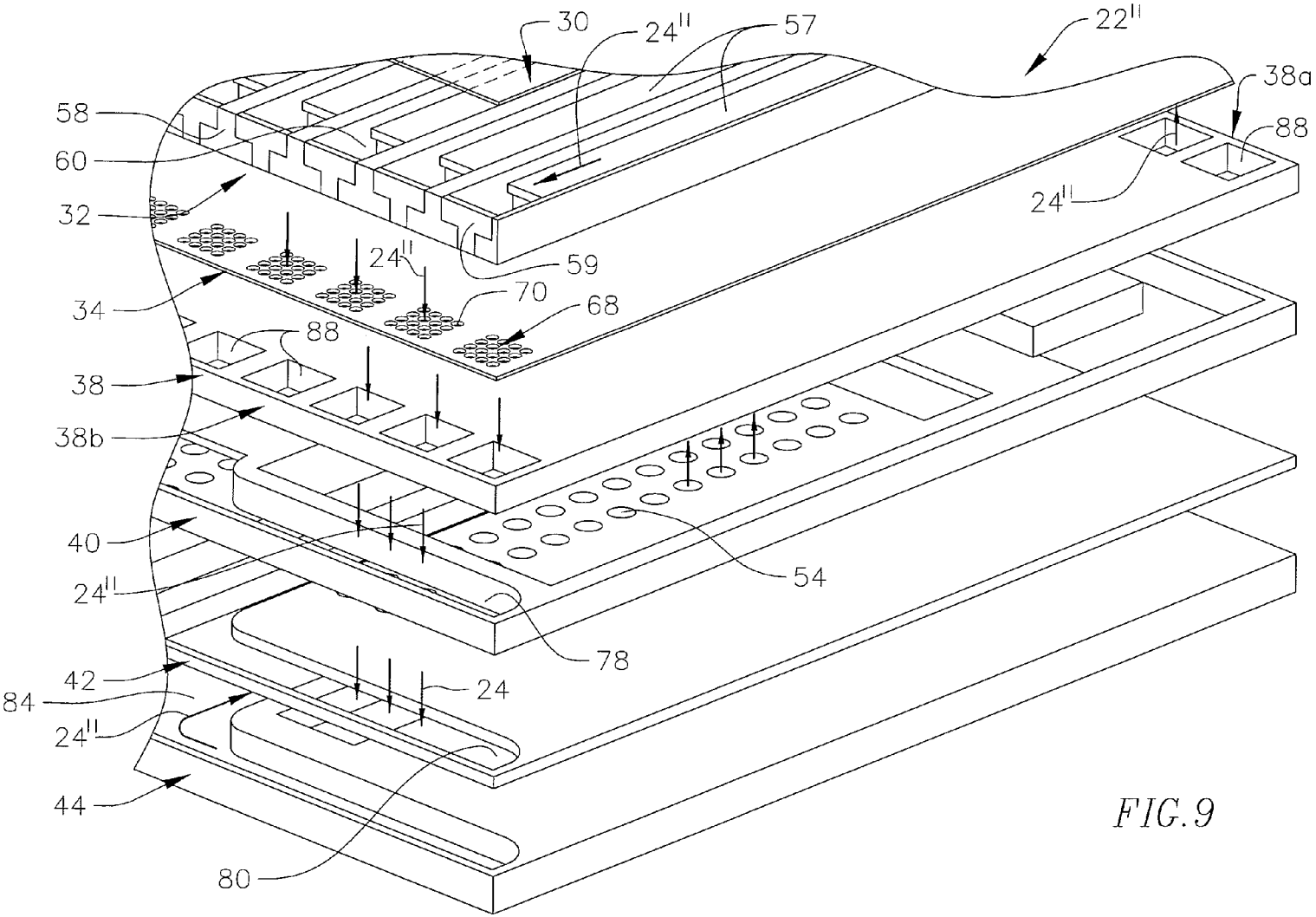
FIG. 9 is a partial exploded view of a panel array antenna according to an embodiment of the invention.

A panel assembly 22" according to another embodiment of the invention is shown in FIG. 9. In this embodiment, the collection layer 36 is not included, and the openings and fluid passages in the various layers have been rearranged. This embodiment gives just one example of how the layers in the assembly 22" and the openings and passages through these layers can be arranged differently, according to the particular antenna and its desired performance. Specifically, in FIG. 9, the radiating layer 32 includes stubs 58 and channels 60 extending between the stubs 58. The flow path 24" passes through the channels 60 and then down through screens 68 in an intermediate layer 34. Below the intermediate layer 34 is an electronics layer 38, which includes various electronic devices that receive and/or transmit radio frequency signals.

In this embodiment, the electronic devices have been packaged on the electronics layer 38 in a compact way that allows the layer 38 to include large openings 88 at opposite ends 38*a*, 38*b* of the electronics layer 38. Comparing to the embodiment of FIG. 5, the holes 88 in FIG. 9 are larger than the small openings 74 that are spaced throughout the layer 38 in FIG. 5. The sizing and distribution of the openings in the electronics layer depends on the arrangement of electronic devices on this layer. Because the layer 38 in FIG. 9 is arranged such that the larger openings 88 can be accommodated at the opposite ends of the layer 38, the collection layer 36 is omitted. In FIG. 5, the collection layer 36 was used in part to fan out the fluid toward the electronics layer, in order to spread the fluid out so that it could pass through the smaller openings 74 that were distributed along the electronics layer in FIG. 5. By contrast, in FIG. 9, the fluid can continue to pass straight through the larger holes 88 without the need to distribute the fluid through smaller holes spread out across the electronics layer 38. Similarly, when the fluid passes back up toward the radiating layer 32, the fluid passes through the holes 88 at the first end 38*a* of the electronics layer 38, and then directly up through the screens 68. The collection layer 36 is not needed in this embodiment to collect the fluid from the smaller openings 74 (see FIG. 5) and direct it toward the screens 68.

Referring again to FIG. 9, after the fluid passes through the holes 88 in the electronics layer 38, it passes through a slot 78 in a distribution layer 40. Comparing again to FIG. 5, the distribution layer 40 in FIG. 9 omits the channels 76 that direct the fluid in FIG. 5 toward the slot 78. As described above, the fluid in FIG. 9 is not fanned out as it passes away from the radiating layer 32, so the channels 76 that are shown in FIG. 5 are not necessary to redirect the fluid back toward the slot 78. Accordingly, the fluid passes through the slot 78 and then through a slot or opening 80 in a jet impingement layer 42. From there, the fluid flows through a plenum 84 in a circulation layer 44. The fluid passes through fans or blowers in the circulation layer 44 and then through nozzles 54 in the jet impingement layer 42, which direct the fluid onto the electronic devices in the electronics layer 38. The fluid absorbs heat from these electronic devices as the flow impinges on each device. The heated fluid then moves back up toward the radiating layer 32 through the openings 88 and screens 68, and then back through the channels 60 to complete the fluid flow path 24".

In one embodiment, the fluid cooling system described above improves the operating temperature of the antenna in two ways. First, the fluid dissipates heat to the jet stream, as described above, as the fluid passes through the channels 60. Second, the fluid reduces the temperature gradient of the antenna. Typically the bottom surface 64 of the panel assembly has a much higher temperature than the top surface 31, which is exposed to the cold jet stream 16. However, when the heated fluid 26*i* reaches the first end 60*a* of the channel 60, it is hotter than the jet stream, and thus the heated fluid 26*a* increases the temperature of the top sheet 30. Also, the cooled fluid 26*b* travels down through the flow path toward the bottom surface 64, reducing the temperature of the bottom surface. Thus, the two temperature extremes are brought closer together, with the fluid acting as a buffer between them. Reducing this temperature gradient can be beneficial, because a large temperature gradient can affect the structural integrity of the antenna and the mounting frame that attaches the antenna to the aircraft. Because different materials within the antenna have different coefficients of thermal expansion, they may expand at different rates, potentially leading to a structural failure of the antenna and/or its mounting structure.

In one embodiment, the flow path is closed-loop, such that the fluid 26 recycles through the path (see FIGS. 5-8). As mentioned before, a pump can be provided, such as for example a pump mounted in or next to the circulation layer 44, to replenish any fluid lost to leaks and to maintain the fluid in the flow path at a sufficient pressure to continue circulating through the path.

As shown in FIGS. 5-9, the flow path 24, 24" moves generally along a first end 22*a* of the panel assembly as the fluid moves toward from the top sheet 30, and the flow path moves generally along a second end 22*b*, opposite the first end 22*a*, as the fluid moves away from the top sheet 30. The channels 60 extend between the two ends 22*a*, 22*b*. Notably, the direction of the fluid through the channels 60 relative to the direction of the jet stream 16 is not important. The jet stream can flow in any direction over the top surface 31.

Figure 10:
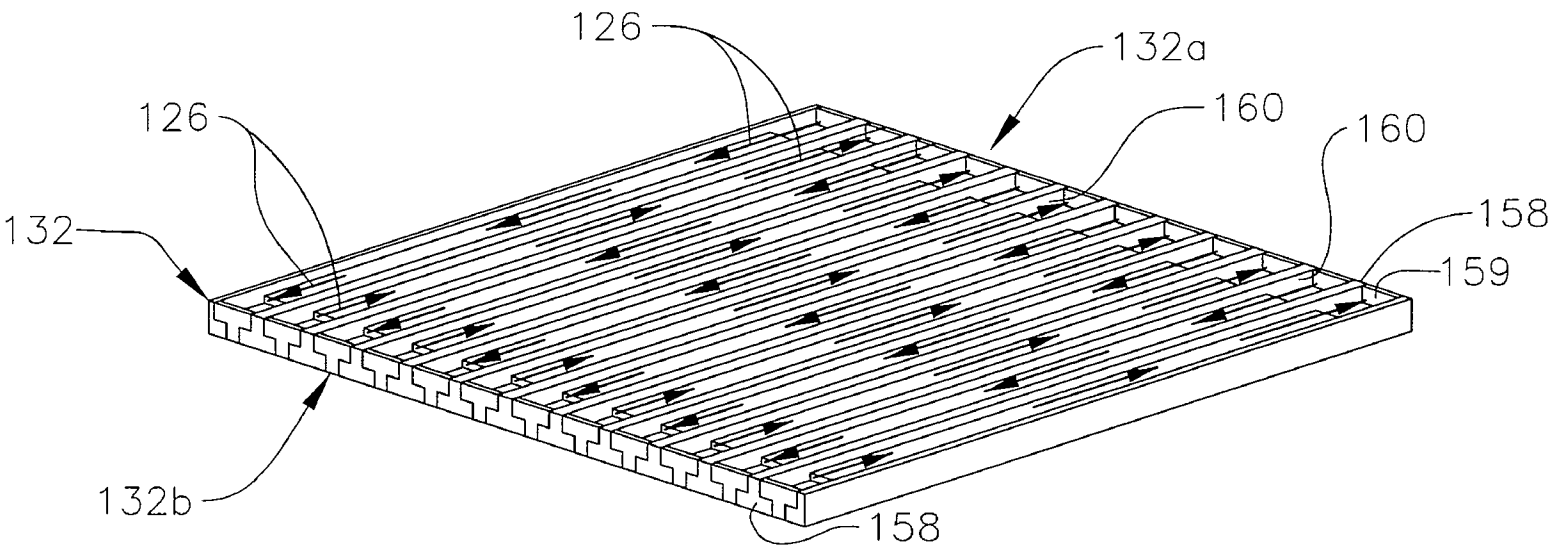
FIG. 10 is a perspective view of a layer of a panel array antenna according to an embodiment of the invention.

Additionally, in one embodiment, the direction of fluid flow through the channels alternates. FIG. 10 shows a radiating layer 132 with channels 160 between pairs of stubs 158, with the channels 160 closed at each end by a cap 159. A fluid 126 moves through the channels 160. In a first channel, the fluid 126 moves from one end 132*a* of the layer 132 to the opposite end 132*b*. In the next adjacent channel, the fluid 126 moves in the opposite direction, from end 132*b* toward end 132*a*. Thus, the flow path has opposing flow directions in a single layer of the panel assembly, in order to mitigate adverse temperature gradients. In this embodiment the alternating flow paths are included in the radiating layer 132, but in other embodiments they can be included in other layers, or in multiple layers. The flow path can be redirected as necessary throughout the panel assembly to route the fluid 126 in the opposing directions through the layer 132.

In embodiments of the invention, a panel assembly with the closed loop fluid flow path can operate without a cooling plate attached to the bottom surface 64 of the panel assembly. The panel assembly dissipates its own heat to the jet stream 16, without requiring any additional mechanism for heat dissipation. Thus, the panel assembly does not rely on the aircraft's own environmental control system or onboard cooling system to dissipate heat from the assembly. As a result, the panel assembly can be mounted in locations around the aircraft without the constraints of a cooling plate or connection to the aircraft cooling system.

When multiple panel assemblies are provided on an aircraft, each assembly may have its own internal cooling system as described above. The panel assembly 22, 22', 22" can be made in a variety of sizes. In one embodiment, the top surface 31 of the panel assembly is one square foot in area, or smaller. Each additional panel assembly added to the aircraft includes its own cooling system.

In one embodiment, the panel assembly 22, 22', 22" is powered by the aircraft's on-board power system. That is, the fans and (optionally) the pump are powered by the aircraft's on-board power. In another embodiment, they are powered by a battery.

As described above, the fluid flow path passes under the top sheet 30 to dissipate heat through the top sheet 30 to the jet stream outside the aircraft. Heat can be dissipated in this way if the jet stream is at a lower temperature than the heated fluid in the flow path. Typically, the antenna 20 is operated only while the aircraft is in flight, rather than when it is stationary on the ground. While the aircraft is in flight, the jet stream will typically be cooler than the heated fluid. However, in one embodiment, the cooling system is designed for sub-sonic flight, meaning that the speed of the aircraft is below Mach 1. Above that speed, it is possible for the jet stream passing around the aircraft to generate enough friction that it heats up to a higher temperature than the antenna, in which case the fluid in the flow path may not be able to dissipate heat to the jet stream. Accordingly, the antenna may be limited to use during sub-sonic flight conditions, or only brief periods of super-sonic flight.

In embodiments of the invention as described above, an improved panel assembly utilizes a unique closed-loop cooling system that is integrated into the panel assembly itself, passing through the antenna's functional architecture. The cooling system dissipates heat directly through the outer skin of the aircraft to the jet stream outside the aircraft. This panel assembly is more compact, efficient, and self-contained than prior art designs that require cooling plates or other external cooling systems attached to the antenna. As a result, the improved panel assembly can be mounted in many locations on the aircraft, such as on a curved surface like the aircraft wing, without the constraint of an external cooling system or connection. Additionally, the assembly requires less power from the aircraft as compared to the prior art, leading to longer flight durations and/or more power available for other systems. Initial modeling of the cooling system according to one embodiment of the invention showed the potential to provide 2-4 $W/in^2$ of heat rejection from the panel array antenna.

Although the present invention has been described and illustrated in respect to exemplary embodiments, it is to be understood that it is not to be so limited, since changes and modifications may be made therein which are within the full intended scope of this invention as hereinafter claimed. For example, the openings, holes. and flow passages in the various layers of the panel assembly can be arranged in different configurations, other than those specifically shown and described herein, to provide a fluid flow path through the panel assembly. The openings are not confined to the specific slots, holes, and passages shown. Additionally, while the panel array antenna has been described for use on an aircraft, it is not limited to that application, as it can also be used on other platforms such as ground vehicles, water vehicles, space vehicles, etc. Also, the antenna architecture is not limited to the specific layers and configuration described above. The various layers in the panel assembly can differ, with some layers being removed or additional layers being added, depending on the purpose and performance of the particular antenna.

What is claimed is:

1. A panel array antenna, comprising:

a panel assembly comprising:

a top layer through which the antenna radiates or receives a signal; and a radiating layer below the top layer; and a fluid flow path through the panel assembly, wherein a first portion of the fluid flow path is disposed between the top layer and the radiating layer such that a fluid passing through the first portion of the fluid flow path is in heat transfer proximity to the top layer.

2. The panel array antenna of claim 1, wherein the fluid flow path forms a closed loop.

3. The panel array antenna of claim 1, wherein the panel assembly further comprises an electronics layer beneath the top layer, and wherein a fluid passing through a second portion of the fluid flow path is in heat transfer proximity to the electronics layer.

4. The panel array antenna of claim 1, wherein the panel assembly further comprises a plurality of layers, including an intermediate layer, an electronics layer, and a fluid circulation layer.

5. The panel array antenna of claim 4, wherein the intermediate layer comprises one or more screens that allow passage of the fluid and block passage of a radio frequency signal radiated by the antenna.

6. The panel array antenna of claim 4, wherein the circulation layer comprises one or more blowers communicating with the flow path to move the fluid through the flow path.

7. The panel array antenna of claim 4, wherein the panel assembly comprises one or more nozzles directing the fluid toward the electronics layer.

8. The panel array antenna of claim 7, wherein the nozzles direct the fluid toward one or more fins on the electronics layer.

9. The panel array antenna of claim 4, wherein the electronics layer comprises one or more openings through which the fluid passes.

10. The panel array antenna of claim 4, wherein the radiating layer comprises one or more channels extending below the top layer, and wherein the fluid passes through the channels.

11. The panel array antenna of claim 1, wherein the fluid is pressurized.

12. The panel array antenna of claim 1, wherein the panel assembly is mounted to an aircraft, and wherein an outer surface of the top layer is exposed to a jet stream around the aircraft.

13. The panel array antenna of claim 12, wherein the panel assembly substantially conforms to the jet stream.

14. A panel array antenna, comprising:

a top layer;

a radiating layer comprising one or more channels below the top layer;

an intermediate layer comprising one or more screens below the radiating layer;

an electronics layer comprising one or more openings and one or more electronic devices below the intermediate layer;

a fluid flow path passing through the channels, the screens, and the openings; and one or more fans that circulate a fluid through the fluid flow path.

15. The panel array antenna of claim 14, wherein the top layer is exposed to atmospheric air outside the antenna.

16. The panel array antenna of claim 14, wherein the fluid flow path is closed-loop.

17. The panel array antenna of claim 14, wherein the fluid flow path comprises a plurality of branches that pass around the electronic devices.

18. The panel array antenna of claim 14, wherein the antenna is mounted into an outer layer of an aircraft.

19. The panel array antenna of claim 18, wherein the antenna is jet stream conformal.

20. The panel array antenna of claim 14, further comprising an air distribution layer comprising one or more nozzles directed at the electronics layer, and wherein the fluid flow path passes through the nozzles.

* * * * *